United States Patent [19]

Dodge et al.

[11] 4,415,800

[45] Nov. 15, 1983

[54] METHOD AND APPARATUS FOR MONITORING AND CONTROLLING HEATED FUSERS FOR COPIERS

[75] Inventors: John H. Dodge, Thornton; Larry M. Ernst, Boulder, both of Colo.

[73] Assignee: International Business Machines Corporation, Armonk, N.Y.

[21] Appl. No.: 295,435

[22] Filed: Aug. 24, 1981

[51] Int. Cl.[3] ..... H05B 1/02

[52] U.S. Cl. ..... 219/497; 219/216; 219/505; 355/14 R

[58] Field of Search ..... 219/492, 497, 499, 505, 219/494, 507, 509, 506, 501, 216; 307/117, 310; 355/14 FU

[56] References Cited

U.S. PATENT DOCUMENTS

| | | | |
|---|---|---|---|
| T 100,804 | 7/1981 | Ernst | 355/14 FU |
| 3,526,272 | 9/1970 | Watts et al. | 219/497 |
| 3,821,516 | 6/1974 | Hayes et al. | 219/497 |
| 3,878,358 | 4/1975 | Barton et al. | 219/497 |
| 3,936,658 | 2/1976 | Traister et al. | 219/216 |
| 3,989,370 | 11/1976 | Mooney | 355/14 |
| 4,006,985 | 2/1977 | Hutner | 355/14 |
| 4,046,990 | 9/1977 | White | 219/505 |
| 4,145,599 | 3/1979 | Sakurai et al. | 219/216 |
| 4,162,847 | 7/1979 | Brandon | 355/14 |
| 4,163,892 | 8/1979 | Komatsu et al. | 219/216 |
| 4,324,486 | 4/1982 | Nishikawa | 219/216 |
| 4,340,807 | 7/1982 | Raskin et al. | 219/216 |

*Primary Examiner*—M. H. Paschall

*Attorney, Agent, or Firm*—Earl C. Hancock

[57] ABSTRACT

Copier fuser roller temperature is monitored during the warm-up period by a series of decreasing temperature threshold levels. Each threshold level is monitored for a preselected time period and reduced for the next time period. The sampling continues until the fuser roller temperature sensed by a thermistor or the like exceeds the threshold level. At that point, the control logic for the copier is enabled for normal copying since the fuser roller temperature profile is then approaching at an adequate level for proper fusing of copy sheets. Fuser over-temperature, under-temperature and failure conditions are determinable.

4 Claims, 12 Drawing Figures

METHOD AND APPARATUS FOR MONITORING AND CONTROLLING HEATED FUSERS FOR COPIERS

CROSS-REFERENCE TO RELATED APPLICATION

Application Ser. No. 102,508 entitled "Automatic Temperature Controller for an Electrophotographic Apparatus Fuser and Method Therefor" by Cunningham and Gianos filed Dec. 11, 1979 and assigned to the same assignee as the present application shows structure for computer sensing and control of the fuser roll temperature for a copier.

TECHNICAL FIELD

The present invention relates to methods and apparatus for monitoring and/or controlling the temperature of heated fuser structure. More particularly, the present invention relates to methods and apparatus for monitoring the temperature of a heated fuser useful in a xerographic process machine so that appropriate heat levels are applied to the fuser and machine control functions are generated in response to detected temperatures over a period of time. Although not necessarily limited thereto, the present invention is particularly useful for monitoring and controlling the temperature of heated rollers employed for the purpose of fusing images on copy sheets in xerographic processing machines.

BACKGROUND ART

In xerographic copiers, the image of a document or object is latently formed on a photoconductor and developed by application of toner to the photoconductor. The image as represented by the toner pattern is subsequently transferred to a copy sheet. The copy sheet then passes through a fuser which fixes the image in substantially permanent form on the copy sheet. The present invention is concerned with heated such fusing devices and is especially useful in copiers employing heated rollers for the fusing purpose. Although this invention is not limited to the specific structural environment shown therein, U.S. Pat. No. 4,162,847 entitled "Hot Roll Fuser Early Closure Inhibitor" by F. Y. Brandon issued July 31, 1979 and assigned to the same assignee as this application, illustrates one example of a copier environment and hot roll fuser structure.

Minimizing the warm-up time of a heated fuser in a copier is particularly desirable to allow the operator to use the copier as soon as possible after it has been initially turned on. However, it is important to avoid driving the fuser temperature excessively beyond the desired operating temperature because this results in fusing problems as well as reduced life of the fuser.

Early fuser control systems merely employed a predetermined time-out to prevent machine operation until more than adequate time had passed for the fuser to have reached full operating temperature by applying full power to the fuser until the time-out has ended. Typically, the fuser is allowed to return to a standby temperature somewhat lower than the original warm-up temperature. Clearly this procedure required unnecessary delays in availability of the copier. The fixed-time out devices are particularly undesirable where the machine operation is temporarily interrupted as for jam clearances and power immediately returned to the machine. In such cases, the fuser temperature typically is only somewhat below the normal operating temperature and application of warm-up power results in excessive heating at the fuser. Of course, thermal relays are applicable to stop power application when the temperature reaches an excessive level, but the time-out process continues.

Prior art techniques of fuser temperature control include allowing the fuser temperature to cross an operating point twice before permitting copier use. Full power is applied to the fuser upon power initiation until the temperature sensor reaches the desired operating point. The temperature continues to rise overshooting the desired operating temperature. Power is reapplied once the temperature has descended below the operating point a second time and it is then assumed the copier is ready for use. Overshoot is minimized by this procedure but warm-up time is not significantly reduced.

Yet another prior art technique involves introduction of a control temperature below the operating point. Full power is applied to the fuser until the temperature reaches this lower temperature level. Power is then reduced to a set amount. The fuser temperature sensor reflects a movement of the temperature to the operating point. This process minimizes overshoot, but the coasting time added to the total warm-up time, is still significant. Further, if the copier is interrupted in normal operation as for jam clearances so that the temperature drops to a point between the lower level and the operating point, application of full power to the fuser upon repowering of the copier is not possible. This lengthens the waiting time after jam clearances.

Arrangements for fuser temperature control using appropriately coupled circuitry and computers, microprocessors and the like are well known. For instance, coupling of a hot roll sensor into a bridge detector with the voltage difference at the bridge being analog-to-digital converted into a microprocessor for control of a triac as to its time division power-on basis is known. An example of such a system wherein half cycles of triac on-time are controlled is shown in the cross-referenced Cunningham and Gianos application. The Cunningham and Gianos patent shows a processor output of digital data into a comparator for comparison against the digital output of the analog-to-digital converter from the bridge.

Another prior art arrangement employs a thermistor coupled into a bridge for a microprocessor input. Typically the fuser is driven to a high level during the warm-up period, a low level during standby and an intermediate level during copying operations. Again this is performable by half cycle controls of triacs or the like. An example of such a system is shown in U.S. Defensive Publication No. T100804 entitled "Microprocessor Controlled Power Supply for Xerographic Fusing Apparatus" by L. M. Ernst published July 7, 1981 (1008 O.G. 1).

The prior art does not disclose methods and apparatus for both warm-up time and temperature overshoot minimization but this result is advantageously provided by the present invention.

DISCLOSURE OF THE INVENTION

The present invention provides improved temperature control of a heated fuser in a copier in a manner that minimizes warm-up time and temperature overshoot problems. An additional advantage of the present invention is that multiple safety checks are available. The present invention relates to copiers having switches for selective coupling of power to the elements of the copier including a fuser for fusing images onto copy sheets or the like. The copier includes means for heating the fuser and means providing a signal indicative of the temperature of that fuser. The invention contemplates producing a signal of declining magnitude over a predetermined time period in response to closure of the power coupling switch. This declining magnitude signal is compared against the fuser temperature indicating signal. An output is generated whenever this comparison results in an indication that the fuser temperature signal is at least equal to the declining signal so that the copier can be controlled in response to this generated output.

One of the controlling operations available through this invention is that the fuser heater is continuously actuated or enabled until the comparison output is generated. Another is to indicate that a machine failure has occurred if the output is not generated before a predetermined period of time has passed. In the preferred embodiment, the declining signal is produced as a series of steps each of a predetermined duration and representing a segment of the predetermined period of time for declining signal production. The present invention recognizes the delay caused by the thermal differential between temperatures sensed at the fuser sensor and the actual temperature of the fusing surface. This delay is accommodated by controlling the application of full power to the fuser heater until the generated output from the comparison result occurs and thereafter applying an appropriately sized power level to bring the fuser to its predetermined operating temperature. The operation of the copier is preferably prevented until occurrence of the output generation.

The present invention is primarily concerned with control operations for copiers having means for providing signals indicative of the temperature of fuser rollers. As described subsequently for the preferred embodiment, the invention contemplates minimizing the warm-up time for such a copier following application of operating power by comparing the temperature indicating signals against a reference level signal for a plurality of predetermined, sequential time intervals. The reference level signal employed for each successive time interval after the initial time interval is lower than the reference level employed during the immediately preceding time interval so that a stair-step comparison function is produced. A response to the comparison showing that the temperature indicating signal is equal to or greater than the particular reference level employed at any given time results in enabling of the copier to perform normal copy processing even though the copier is not actually at full fuser operating temperature at the instant the comparison result occurs.

Those having normal skill in the art will recognize the foregoing and other objects, features, advantages and applications of the present invention from the following more detailed description of the preferred embodiment as illustrated in the accompanying drawings.

DETAILED DESCRIPTION OF THE PREFERRED EMBODIMENT

The present invention permits normal copy operation of a machine after initial power-on conditions with minimum delay and without requiring any memory of the length of time that power has been removed from the machine. It is particularly well suited for microprocessor control of a copier and adds insignificant additional cost to a system which includes a fuser roll temperature sensor and a microprocessor wherein the temperature signals are coupled to the microprocessor input.

Figure 1:
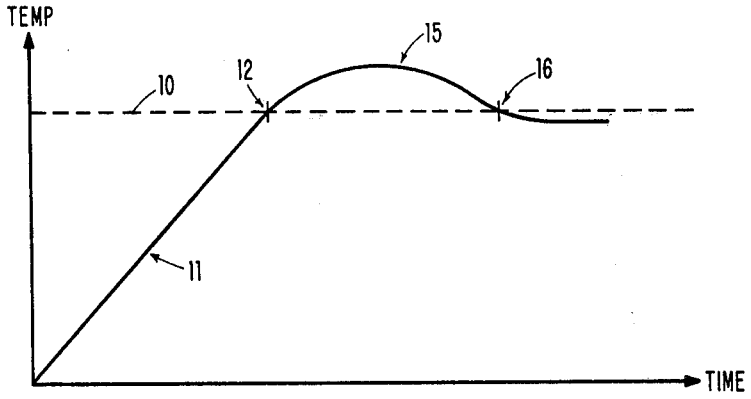
FIG. 1 is a graph of the fuser temperature over a period of time illustrating the overshoot effect when full power is applied until the apparent operating temperature is reached.

FIG. 1 shows a chart of fuser temperature as a function of time where full heater power is either on or off. The preferred operating temperature level 10 is reached by applying full power during the interval at 11 up to the time that equality is sensed at 12. Power is then removed for interval 15 until the operating temperature equality is once again sensed at point 16. In typical prior art arrangements, the copier ready is not indicated until point 16 is reached.

Figure 2:
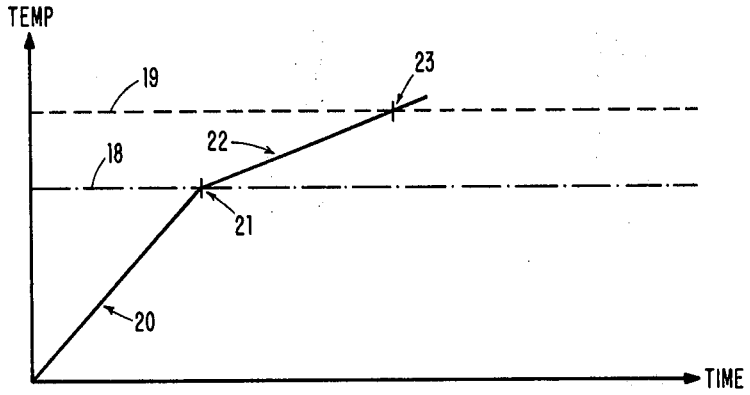
FIG. 2 is a graph of fuser temperature over a period of time illustrating the time delay even though full power is reduced after a lower temperature has been reached.

The delay before indicating copier ready is somewhat reducible by employing controls which produce a result as shown in the graph of FIG. 2 which illustrates fuser temperature as a function of time. That is, a prior art technique introduces a control temperature 18 below the operating temperature 19.

Full power is applied to the fuser during interval 20 until cross-over 21 is detected. A partial power application is employed during interval 22 until the second cross-over 23 occurs which indicates that the fuser temperature has coasted to operating level 19.

Figure 3:
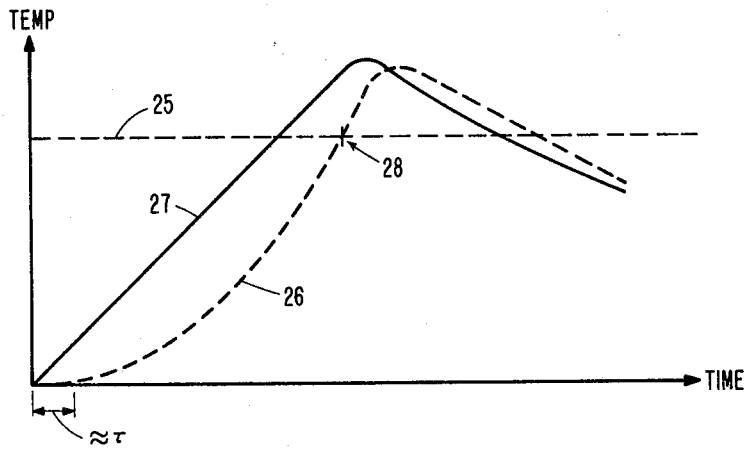
FIG. 3 is another graph of fuser temperature over a period of time illustrating the lag effect and overshoot temperature associated with fuser power control.

In typical copiers, temperature sensing is through a thermistor mounted in a shoe in contact with the aluminum hot roll core. It is known that the temperature of the sensor lags behind the temperature of the hot roll as is shown in FIG. 3. Thus, with a desired operating temperature of 25 and application of full power to the fuser heater, the sensor apparent temperature is illustrated by dashed curve 26 even though the actual fusing surface temperature of the hot roll follows the curve shown at 27. When the apparent cross-over point is detected at 28 and power is switched off of the fuser heater, the actual fuser roll temperature has already exceeded the operating point and will significantly overshoot as illustrated. The present invention addresses this problem by varying the point at which fuser power is adjusted so that the temperature adjustment is referred to herein as "up to temperature" or UTT. The UTT point depends on the beginning value of fuser temperature at machine power-on; it varies depending on whether the machine is turned on after a long power-off period or is repowered after a brief interruption as for clearing jams.

Figure 6:
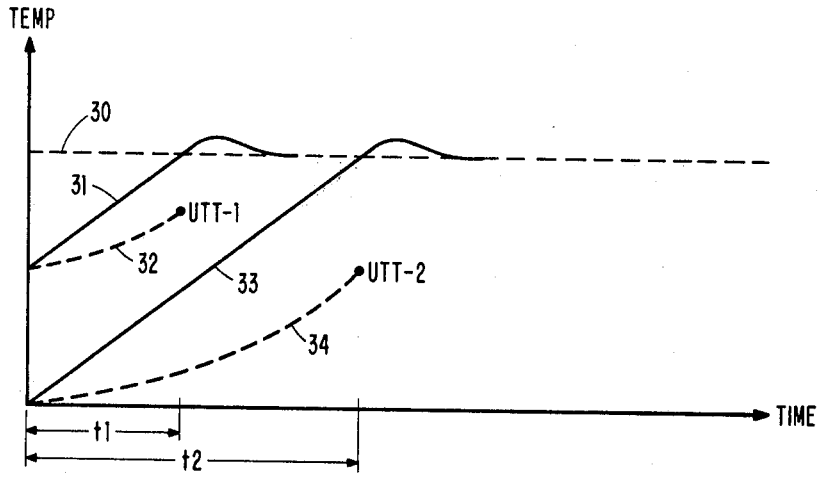
FIG. 6 is a graph of temperature over periods of time showing the declining temperature comparisons associated with operation in accordance with this invention.

FIG. 6 illustrates the typical declining level of UTT for fuser temperature sensing in accordance with this invention. This declining magnitude of UTT reflects recognition that the hot roll temperature reaches the desired operating temperature as a function of its power-on history. The magnitude of UTT at any given period also effectively compensates for sensor lag.

FIG. 6 shows the temperature over time for power to the fuser which is switched at the UTT times in accordance with this invention. Assuming the copier fuser is still relatively warm when machine power is turned on, as is frequently the situation after jam recovery operation, the desired operating temperature 30 for the fuser is reached beginning from a relatively high initial temperature as is shown by curve 31. The initial temperature level UTT-1 is approached by sensor output 32 and, when UTT-1 is reached, it is known that the fuser will reach the proper operating temperature 30 by the time the fuser is required to perform a copy fusing operation. Therefore power is switched off with the fuser temperature reaching level 30 with minimum overshoot. The copier control logic decides when the fuser temperature reaches UTT that the fuser is immediately available for copying. This occurs at the end of time period t1 in FIG. 6.

A cold copier start is reflected by profile 33 for the actual fuser temperature and profile 34 for the lagging sensor output. The controls in accordance with this invention initially endeavor to compare the sensor output 34 against UTT-1 level but subsequently reduce the comparison level such as by switching to the lower UTT-2 level. The copier is determined as up to temperature at time t2 and is then ready for copier operations. The copier controls (e.g. a microcomputer or the like) vary the value of UTT with a look-up table whose values satisfy the equation:

$$UTT = Top - (\Delta T)(1 - e^{-t/\tau})$$

where

Top is the operating temperature, $\Delta T$ is a constant, t is the time of full power application to the fuser, and $\tau$ is the thermal time constant between the hot roll and sensor as described earlier (see FIG. 3).

Figure 4:
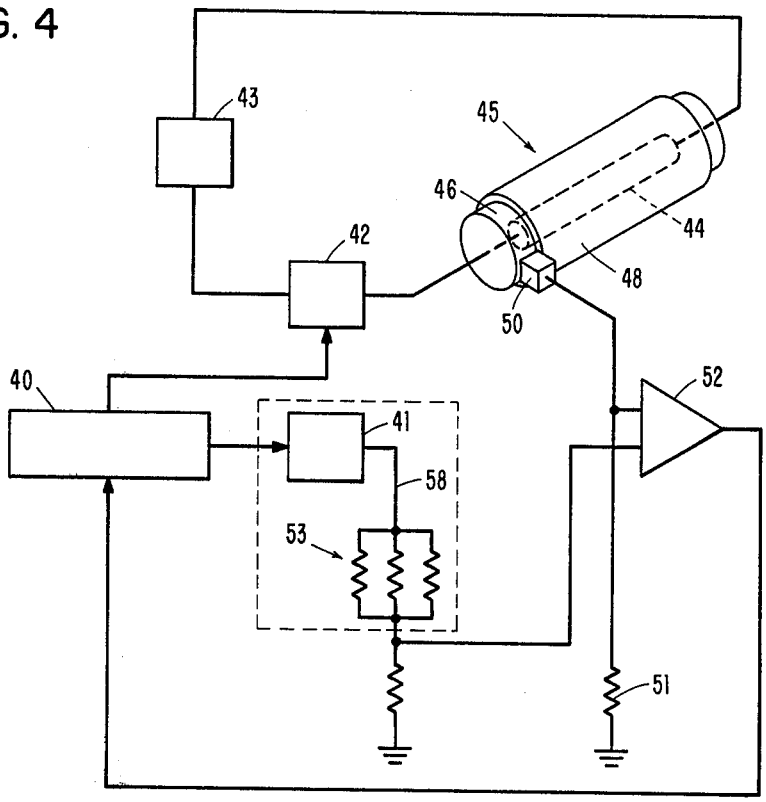
FIG. 4 is a schematic diagram of the elements and control system useful in accordance with the present invention.

Typical circuitry for implementing the preferred embodiment of the present invention is illustrated in schematic form in FIG. 4. It includes a conventional microcomputer 40 with outputs coupled to a digital-to-analog converter 41 and a drive circuit 42 which typically includes a triac switch. That is, drive circuit 42 selectively couples electrical power from power source 43 to the lamp 44 located internally to hot roll fuser 45. Hot roll fuser 45, as is conventional, includes a hollow core 46 fabricated of heat conducting material such as aluminum, and a coating 48 for performing the function of directly applying the fuser heat to copy sheets as they pass through the nip of roller 45 with a back-up roller (not shown). Sensor 50 is positioned to detect the temperature of core 46 and is a conventional thermistor element or the like. Coupling of thermistor 50 onto the end of core 46 as shown is preferred rather than to directly sense the temperature of the surface of roller 48 to prevent wear of that roller and degradation of fusing.

Comparator 52 has one input coupled to sensor 50 and the other input coupled to the output from digital-to-analog converter 41 through resistor network 53. Thus comparator 52 is effectively coupled to a resistance bridge, one side of which is a variable resistance from the microcomputer 40 controls and the other side of which is the temperature sensing element 50.

Figure 5:
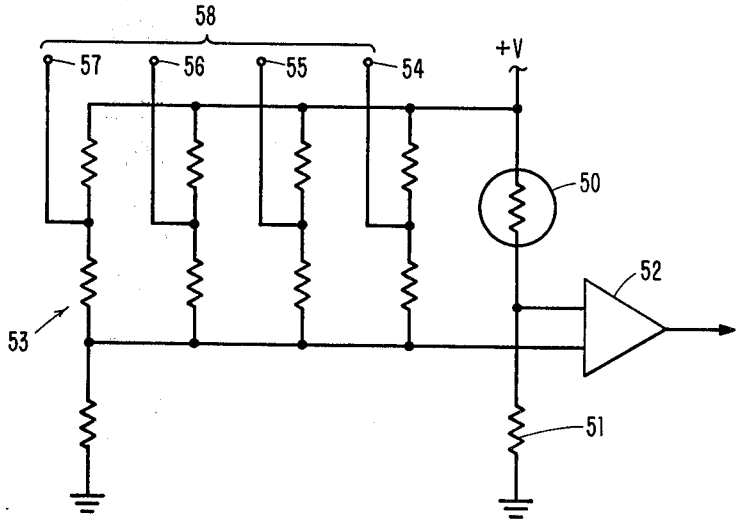
FIG. 5 is a diagram of a typical digital-to-analog conversion circuit useful in the FIG. 4 configuration.

FIG. 5 shows a typical application of output 58 from digital-to-analog circuit 41 through network 53 to provide one input to comparator 52. Terminals 54–57 represent respective binary outputs of digital-to-analog converter 41 which drive network 53 from the power source +V so that their summation is applied to comparator 52 for comparison against the signal developed in correlation to the resistance of thermistor 50.

Figure 8:
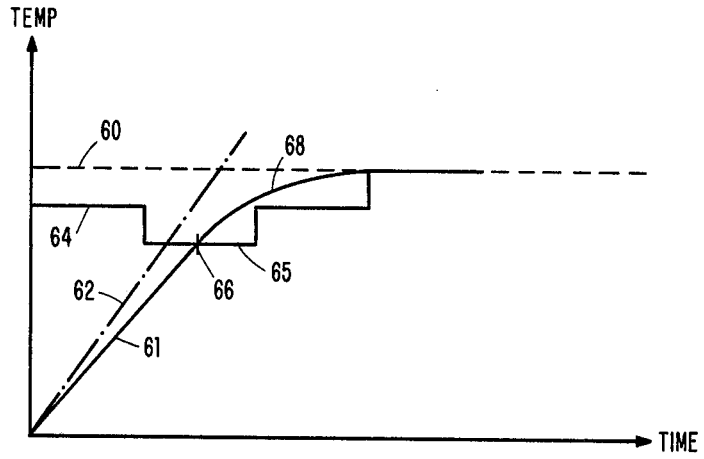
FIG. 8 is a graph of fuser temperature over a period of time illustrating the stepped temperature monitoring in accordance with this invention.

Operation of the FIG. 4 system by microcomputer 40 is represented by FIG. 8 which is a chart of multiple level comparisons against the fuser temperature over a period of time. With time, microcomputer 40 outputs a bit pattern to the D/A converter 41 that varies the resistance in the bridge circuit thus creating a varying comparison temperature. The preferred fuser roller operating temperature is shown at 60. The comparison temperature varies as a series of reducing steps as shown in FIG. 8 to allow for the temperature difference between the temperature sensor 61 and the actual temperature 62 at the fuser. This difference is at least partially the result of the thermal lag between the sensor 50 and the sensing surface, the temperature differential between sensor 50 and fusing surface 48, and/or the thermal resistance of sensor 50 itself.

To best track actual fusing temperature 62 (i.e. accounting for the temperature difference), the values of comparison temperatures and the time between changes are coded in the microcomputer. Thus an initial temperature sensing level 64 is used for comparison against sensor temperature 61 for an initial predetermined time period. If a comparison fails to occur by the end of this initial time period, the sensor level is reduced to the level shown at 65. Full fuser heater power is applied until cross-over point 66 is detected and, thereafter, a reduced or varying power is applied during interval 68 until the sensor temperature 61 corresponds to the desired operating point 60. Accordingly, FIG. 8 shows how microcomputer 40 reaches a decision as to the actual fusing temperature 62 based on sensor 50 temperature. When the sensor 50 output reaches UTT at 66, it is known that the actual fusing temperature is approaching operating point 60 so that copying operation start-up is acceptable.

The time span and temperature level for each step when designing a particular machine is determined as a function of the temperature characteristics of the sensor and fuser structure involved. By way of example, from one machine design the value of time for each UTT was taken as 34.1 seconds ($2^{12} \times 0.00833$ seconds = 34.1 seconds). The value of $2^{12}$ is convenient for counting in four-bit binary arithmetic. Given this timing for temperature level switching, the temperature levels were chosen to approximate the sensor/fuser temperature characteristics wherein the sensor was a commercially available graphite shoe having a thermistor and a thermal fuse mounted therein, and the fuser was constructed with a hollow aluminum core of 49 mm diameter, 256 mm length and 2.8 mm thickness having a 1.27 mm inch thick coating of a silicon rubber thereon and a 510 watt, 127 vac heater element within the core.

Figure 9:
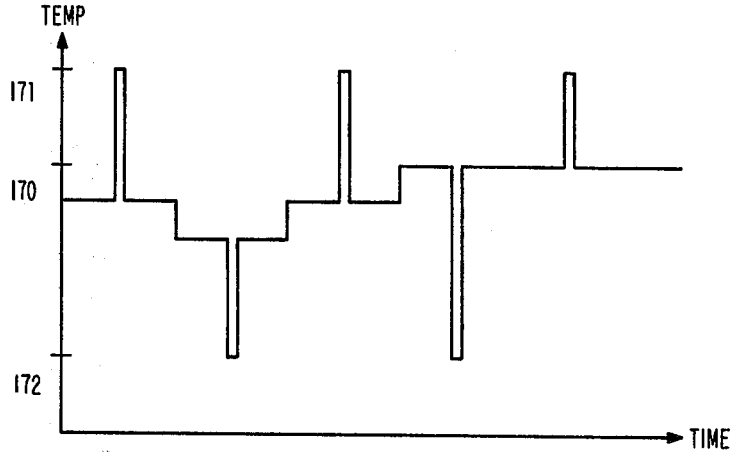
FIG. 9 is a graph of temperature comparison levels over periods of time showing both control and safety check function.

Three safety checks can be included; fuser over-temperature, fuser under-temperature and fuser not up to temperature in adequate time. Microcomputer 40 performs the over-temperature and under-temperature checks with the same circuit as in FIGS. 4 and 5 and varies the comparison temperature for short amounts of time. FIG. 9 shows the combination of comparison temperatures and safety checks. In the chart of FIG. 9, temperature level 170 is the operating temperature and levels 171 and 172 represent sensing of over-temperature and under-temperature conditions, respectively. Failing a safety check results in removal of power from the copier and indication of a machine failure to the operator. The check for fuser over-temperature condition verifies the operation of the fuser drive circuit. A fuser under-temperature verifies thermal contact of the temperature sensor to the hot roll. An under-temperature decision is made by the microcomputer only after the temperature has reached UTT. That is, the fuser is obviously under temperature until it warms up. This check determines if the temperature drops to an unacceptable level after warm-up. If the temperature does not reach UTT within a given time, the microcomputer determines that a failure exists.

As mentioned, in FIG. 9 is a diagram of both the safety check comparison levels and the moving UTT comparison level. Every 34.1 seconds (offset from the change in UTT every 34.1 seconds), the microcomputer performs a safety check, alternating between over-temperature and under-temperature. An over-temperature condition is the fuser temperature exceeding the maximum expected temperature. This results due to a shorted triac, a short in the fuser cabling or a failure at the microcomputer output. An under-temperature condition occurs when the fuser temperature drops from the operating temperature and falls below the minumum expected temperature. This results from an opened fuser triac, an open in the fuser cabling, or lack of thermal feedback from the hot roll. The under-temperature test is not performed until the fuser temperature reaches the operating point. It then tests for the fall or drop. Applying full power to the fuser should result in the fuser up to temperature in a known time (in our case, 5.2 minutes). If the fuser temperature does not reach the UTT level within this known time, the microcomputer stops powering the fuser and signals a failure to the machine operator.

Once the copier has reached UTT, the comparison temperature is increased in increments related to $\tau$ (thermal time constant between hot roll and sensor shoe) until it equals the desired operating point. During normal copier use thereafter, the comparison temperature varies between a standby control point and a copy control point using the circuit of FIGS. 4 and 5. For some machines, only a copy temperature level comparison is not needed.

Figure 7:
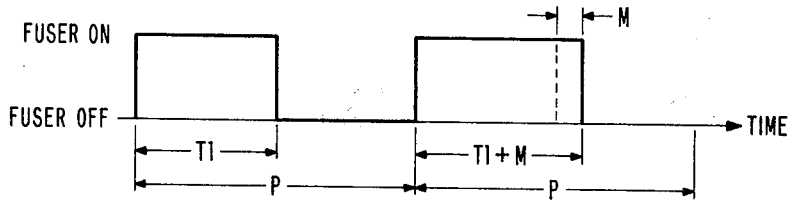
FIG. 7 is an illustration of the incremental on/off time for fuser heater control.

Power is applied to the fuser in varying amounts once the temperature has reached UTT. FIG. 7 illustrates time division power control for two consecutive time periods P during which the fuser is powered on during T1 and T1+M. The next value of T is decided at the beginning of each time period P. If the temperature sensed is below the comparison temperature, T is incremented one time unit. In FIG. 7, there is illustrated an added time increment M in the second time period P. If the sensed temperature is above the desired operating level, T is decremented one time unit. The fuser power now can vary between full power and partial power. The value of time incremented or decremented can vary depending on the mode of machine operation (e.g. copy or standby).

As is apparent from the foregoing, the exemplary preferred embodiment of a hot roll fuser control system is implemented through a microcomputer and variable resistance bridge as shown in FIGS. 4 and 5. This system allows a shortened warm-up time of the fuser without incurring temperature overshoot of such a level as to delay copy starting. Energy is varied (power X time) to the fuser lamp 44 based on comparisons to a sequence of reference temperatures, the mode of machine operation and fuser temperature history. The microcomputer 40 makes decisions based on multiple temperature comparisons concerning fuser over-temperature (indicating an unsafe, runaway condition), fuser under-temperature (checking for thermal conductivity of temperature sensor to hot roll), and up to temperature (signaling end of fuser warm-up).

In order to supply sufficient energy to fuser lamp 44 to properly affect copy sheet fusing, microcomputer 40 controls the energy to lamp 44 by varying the time during which power is applied. Although P generally remains constant, the values of T in FIG. 7 are adjusted to decrease or increase energy to fuser lamp 44. The microcomputer 40 does this, for example, at the beginning of each P in conformity with the following rules:

If temperature is low, increase T by X. If copier is making copies, increase T by Y. (More power is needed to supply fusing requirements.) X is less than Y.

If temperature is high, decrease T by X. If copier is making copy, decrease T by Z, where Z is less than X.

Figure 12:
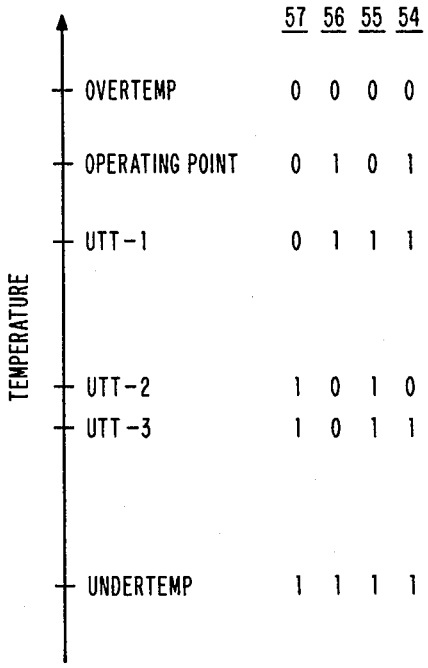
FIG. 12 is a table of various digital output combinations from a computer to a digital-to-analog converter for different operation conditions.

Given the $2^n$ possibilities that "n" microcomputer control lines give, multiple comparisons are generated using the circuit shown in FIG. 4. FIG. 12 shows a table of various digital combinations storable in the microcomputer memory. The microcomputer selects from this table to enable lines 54–57 of the DAC/comparator circuitry as a function of the status of the machine operation. Thus, FIG. 12 is a chart of possible comparisons and their meanings taken in conjunction with the following notes:

overtemp: the hot roll temperature has exceeded a maximum expected value and a runaway condition is sensed. The power to the roller is removed immediately.

operating point: the operating temperature of the fuser is at the correct level.

UTT-1: the up to temperature level used for time period t1.

UTT-2: up to temperature level for time period t2.

UTT-3: up to temperature level for timer period t3.

undertemp: temperature is below minimum expected value—no contact is presumed if it is known the heater was on for predetermined time period.

Figure 10:
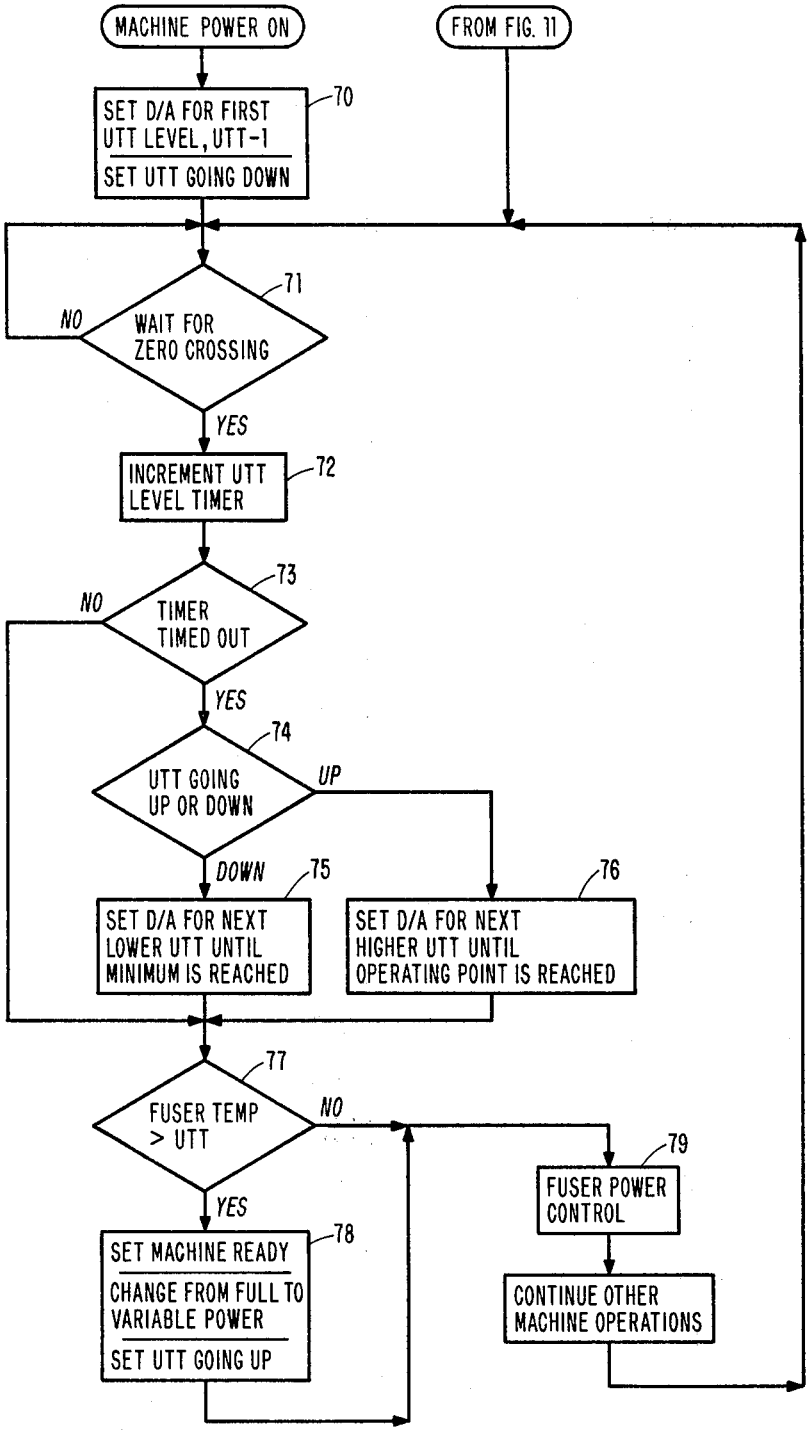
FIG. 10 is a flowchart showing the process for deciding upon the temperature step to be used at a given period of time.

FIG. 10 is a relatively self-explanatory flowchart of the sequence the microcomputer goes through in deciding to shift from one UTT level to another until the fuser temperature reaches a UTT level. The fuser timers are conventional clock pulse counters implemented internally to the microcomputer. A separate timer is used to signal that an excessive time has passed without the fuser temperature ever reaching a UTT level. The fuser temperature is tested against UTT-1 for a predetermined time period (e.g. 34.1 seconds in the example described previously) before shifting to UTT-2. Note that the time spans for the UTT level comparison can differ. As shown in decision block 77, as soon as the fuser temperature equals or surpasses a UTT level, the copier is ready for use.

In block 70, the initial value for the UTT level is retrieved from the table, stored in memory and placed on the output lines for comparison purposes. In addition, the direction of UTT testing is set. Decision block 71 provides one pass through code each half cycle of the AC power line (i.e., one pass every 8.33 milliseconds). Block 72 controls the UTT level timer. Its purpose is to provide a signal when an excessive time has passed without the fuser temperature reaching the UTT level. Block 73 responds to the condition where the UTT level timer has timed out to change level. The direction of UTT level change is determined at decision block 74. That is, if the direction is down, a lower UTT level is used as in block 75 while, if the direction is up, a raised UTT level is employed per block 76. At block 77, a decision is made as to whether the fuser temperature has reached UTT. Block 78 indicates the responses when the fuser temperature has reached UTT, namely, set machine ready, change from full power to variable power mode, and set direction of UTT to up. At block 79, the fuser power is controlled (note FIG. 11).

Figure 11:
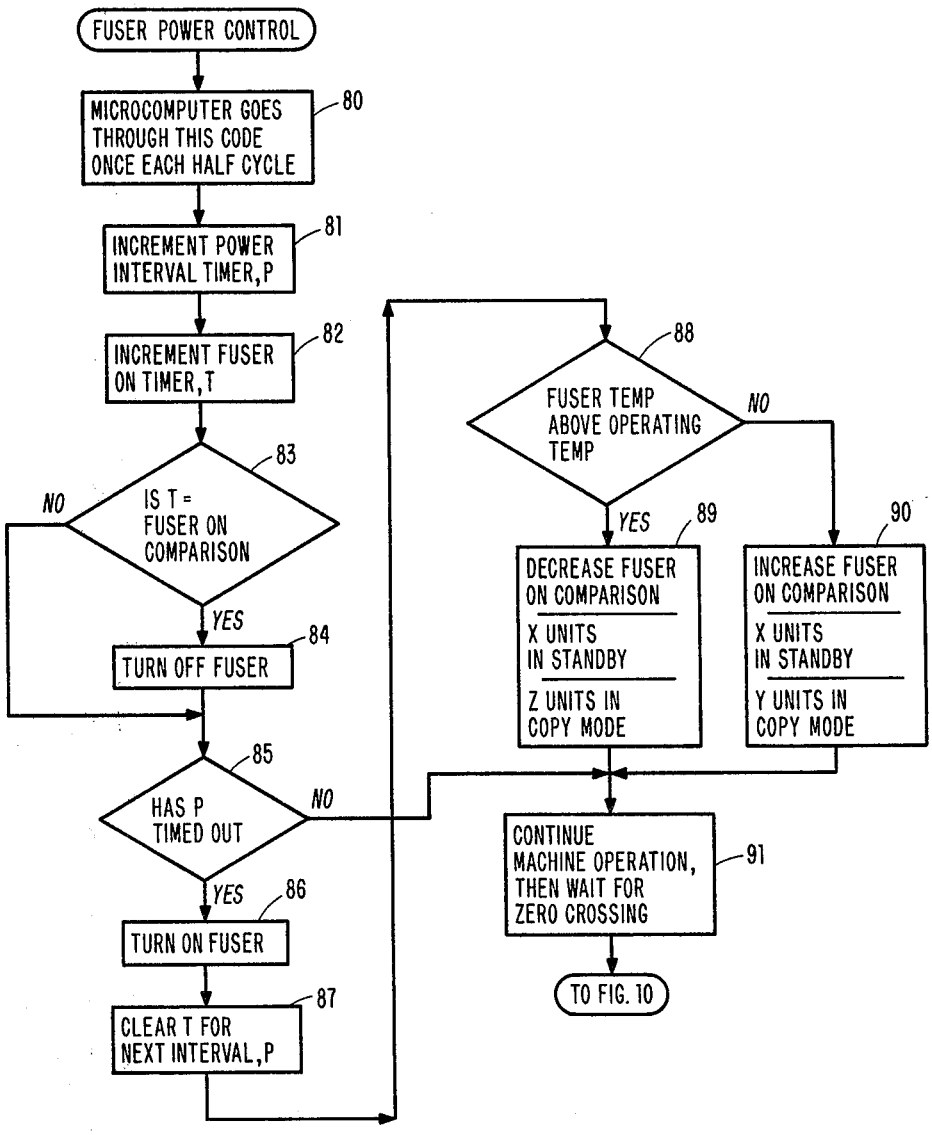
FIG. 11 is a flowchart generally showing varying comparisons in accordance with this invention.

FIG. 11 is a flowchart describing how power is applied to the fuser lamp. Box 80 reflects that these steps follow the operations of FIG. 10. At machine power on, the value of the fuser on comparison value is set equal to P, the power interval timer. Once each half cycle of the AC power line, the power interval timer P is incremented as shown at 81 and the fuser on timer T (how long the fuser is powered on each P) is also incremented at 82. At decision block 83, if the value of the fuser on timer T is equal to the fuser on comparison value, the microcomputer proceeds to block 84 where the fuser is now turned off because it has been on long enough. In decision block 85, the interval timer P is tested to see if the control interval is complete. The value of P is 2.1 seconds in a typical operating example. The response at 86 when P has timed out is that the microcomputer begins another fuser control interval by turning the fuser on. At box 87, the fuser on timer T is cleared (set to zero) for this control interval. In decision box 88, the value of the fuser on comparison value is determined based on the fuser temperature at the beginning of each control interval. The response at 89 if the fuser temperature is above the operating point (i.e., the fuser is warm and less power is required), is that the value of fuser on comparison is decreased. For example, the time the fuser is on is decreased by increments in multiples of 133 milliseconds. The response at 90, if the fuser temperature is below the operating point (i.e., the fuser is cool), is that more power is required. The fuser on comparison is increased in increments of 133 milliseconds, for example. Note that the power increments associated with blocks 89 and 90 can be varied depending on the machine operating mode (i.e., copy or standby). Block 91 reflects that the microcomputer proceeds to other machine operations and returns to the "wait for zero-crossing pulse" box of FIG. 10.

Although the present invention is described with particularity relative to the foregoing detailed description of the exemplary preferred embodiment, those having normal skill in the art will recognize various modifications, changes, additions and applications of the present invention in addition to those mentioned herein without departing from the spirit of this invention.

What is claimed is:

1. In a copier having means for providing signals indicative of the temperature of the fuser rollers, the process for minimizing warm-up time for the copier following application of operating power of regularly occurring cycles to the copier comprising the steps of:

comparing the temperature indicative signals against a reference level for a plurality of predetermined, sequential time intervals each of which has a duration corresponding to the time span of a multiplicity of said regularly occurring cycles of power and wherein the said reference level employed for each successive time interval after the initial time interval is lower than the said reference level employed during the immediately preceding said time interval; and responding to a comparing step wherein said temperature indicative signal is equal to or greater than the said reference level during any said time interval by enabling said copier to perform normal copy processing.

2. In a copier in accordance with claim 1 wherein said copier includes means for heating said fuser rollers, said process including the steps of:

applying maximum power to said heating means until said comparing step indicates said temperature indicative signal is at least equal to a said reference level and thereafter applying reduced power to said heating means.

3. The process in accordance with claim 1 or 2 which includes the steps of signaling machine failure if a predetermined time interval passes without a said comparing step result that said temperature indicative signal is at least equal to said reference level.

4. The process in accordance with claim 1 which includes the steps of:

comparing the fuser temperature indicative signals with a predetermined minimum reference level during at least one of said time intervals and after passage of adequate time for the fuser temperature to reach at least said minimum reference level in normal operation of said copier; and indicating a failure condition when said comparing steps do not reflect a fuser temperature indicative signal at least equal to said minimum reference level.

* * * * *